US006740461B2

(12) United States Patent
Yamashita et al.

(10) Patent No.: US 6,740,461 B2
(45) Date of Patent: May 25, 2004

(54) CARRIER AND TWO-COMPONENT DEVELOPER FOR ELECTROPHOTOGRAPHY

(75) Inventors: Masahide Yamashita, Shizuoka (JP); Masanori Suzuki, Shizuoka (JP); Yohichiroh Watanabe, Shizuoka (JP); Kazuhito Watanabe, Shizuoka (JP); Keiko Shiraishi, Shizuoka (JP); Kohki Katoh, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/324,877

(22) Filed: Dec. 20, 2002

(65) Prior Publication Data

US 2003/0165765 A1 Sep. 4, 2003

Related U.S. Application Data

(63) Continuation of application No. 09/709,795, filed on Nov. 10, 2000, now abandoned.

(30) Foreign Application Priority Data

Nov. 11, 1999 (JP) ..... 11-321412

(51) Int. Cl.[7] ..... G03G 9/113

(52) U.S. Cl. ..... 430/111.35; 430/111.32; 430/111.3

(58) Field of Search ..... 430/111.31, 111.3, 430/111.32, 111.33, 111.35, 137.13

(56) References Cited

PUBLICATIONS

Borsenberger, Paul M. et al. Organic Photoreceptors for Imaging Systems. New York: Marcel–Dekker, Inc. (1993) pp. 6–17.*

* cited by examiner

*Primary Examiner*—Christopher Rodee
(74) *Attorney, Agent, or Firm*—Cooper & Dunham LLP

(57) ABSTRACT

A carrier is composed of carrier particles, each carrier particle having a core particle containing at least a magnetic material and a surface coating layer provided on the core particle containing at least a resin, the surface coating layer being constituted of a plurality of regions, the regions being separately formed and joined together to form a complex configuration, and having different phase lags when the surface coating layer is subjected to scanning by phase imaging measurement using a scanning probe microscope in a tapping mode, wherein a region having a phase lag over the average phase lag obtained from $E_{avg}=\Sigma(E(i)\cdot S(i))/\Sigma S(i)$ has an area SO, and SO and $\Sigma S(i)$ are in a relationship of $10\% \leqq SO/\Sigma S(i)\times 100 \leqq 90\%$ when each region comprises a component A(i) having an area S(i) and a phase lag E(i), in which i represents the number of regions with different phase lags. A two-component developer employs the above-mentioned carrier.

17 Claims, 2 Drawing Sheets

CARRIER AND TWO-COMPONENT DEVELOPER FOR ELECTROPHOTOGRAPHY

CROSS REFERENCE TO RELATED APPLICATION

This application is a continuation of U.S. patent application Ser. No. 09/709,795 filed Nov. 10, 2000 now abandoned.

BACKGROUND OF THE INVENTION

1. Field of the Invention

The present invention relates to a carrier comprising carrier particles capable of imparting electric charges to toner particles when stirred together, and a two-component developer comprising the above-mentioned carrier component and toner component for use with the electrophotographic process.

2. Discussion of Background

According to the electrophotographic image formation process, a latent electrostatic image is formed on an image-bearing member such as a photoconductor, and the latent electrostatic image is then developed to a visible toner image by causing charged toner particles to deposit upon the electrostatic image. The toner image thus formed on the image-bearing member is transferred to an image-receiving material such as a sheet of paper, and fixed thereon by the application of heat, pressure, or solvent vapor thereto. Thus, output images are formed on the image-receiving sheet.

In the above-mentioned electrophotographic image formation process, the development system is roughly divided into two groups depending upon the method for charging the toner particles. One is a two-component development system employing a toner component and a carrier component, in which system toner particles are triboelectrically charged through the stirring operation with carrier particles; and the other is a one-component development system employing only the toner component. In the one-component development system, the toner particles are electrically charged without using the carrier. The one-component development is further divided into a magnetic one-component development method and a non-magnetic one-component development method, depending upon the factor whether a magnetic force is used or not for retaining the toner particles on the development roller.

In light of stable charging characteristics and rapid rise in the charging performance of toner particles, and stable image quality for an extended period of time, the two-component development method has become the mainstream in the copying machine that requires high-speed performance and excellent image reproducibility, and a complex system including such a kind of copying machine. On the other hand, the one-component development method is usually employed for a small-size printer and facsimile machine in view of the factors of space saving and low cost.

In recent years, recycle or reuse of the development unit mainly for the one-component development system has been realized in consideration of environmental destruction. At the same time, in the two-component development system, there is an increasing demand for extension of the life of the developer.

There has been a tendency to decrease the temperature for fixing a toner image from the viewpoint of reduction in consumption energy. Toner particles have been developed so that the toner particles can readily deform and be fixed at lower temperature.

The factors to cause the two-component developer to deteriorate are as follows: (1) wearing of the surface of carrier particles, (2) peeling of the surface coating layer of the carrier particles, (3) crashing of carrier particles, and (4) adhesion of toner component to the surface of carrier particles. Because of those factors, the charging imparting capability of carrier is impaired, a predetermined electric resistivity is varied, and minute fragments and cuttings are produced from the carrier particles. As a result, image quality of the obtained toner images is lowered, for example, a decrease in image density, occurrence of fogging on the background, and a decrease in resolution. In addition to the above, the image-bearing member is physically and/or electrically damaged, and a member for imparting electric charge to the toner is stained.

To solve the above-mentioned problems, there are many proposals. In particular, some proposals are made with special attention being paid to coated carrier particles prepared by providing a coating layer on the surface of magnetic particles.

Japanese Laid-Open Patent Application 9-269614 describes that the surface of carrier particles is coated with a resin coating layer which is prepared by dispersing resin particles and electroconductive finely-divided particles in a matrix resin in order to prevent the so-called spent toner phenomenon from happening for a long period of time.

Japanese Laid-Open Patent Application 9-311504 proposes carrier particles. Each particle comprises a spherical complex core particle comprising an iron oxide particles and hardened phenolic resin, and a surface layer comprising a hardened amino-group-containing phenolic resin, provided on the core particle, with the amount ratio of the iron oxide particles and the content of amino group in the amino-group-containing phenolic resin being particularly specified. This structure of carrier particles is considered effective for obtaining stable triboelectric charging characteristics and durability.

A carrier disclosed in Japanese Laid-Open Patent Application 9-311505 comprises carrier particles, each carrier particle comprising a spherical complex core particle comprising iron oxide particles and hardened phenolic resin. Those core particles are coated with a resin layer prepared by curing a mixture of phenolic resin and at least one resin selected from the group consisting of melamine resin, aniline resin, and urea resin. The carrier thus obtained is superior in terms of triboelectric charging characteristics and durability.

Carrier particles disclosed in Japanese Laid-Open Patent Application 10-198078 are constructed by providing a surface coating layer on core particles, the surface coating layer comprising a matrix resin, and finely-divided resin particles and finely-divided electroconductive particles which particles are dispersed in the matrix resin. Further, the matrix resin for use in the coating layer of the carrier particles contains the same resin component as that constitutes a binder resin for use in toner particles in an amount of 10 wt. % or more. Owing to such a structure, the charge imparting capability of the carrier is not hindered by the spent toner phenomenon.

Japanese Patent 2779976 discloses a magnetic carrier which is prepared by coating core particles comprising ferromagnetic particles and hardened phenolic resin with at least one resin selected from the group consisting of epoxy resin, polyester resin, styrene resin, silicone resin, and fluorine-containing resin. The magnetic carrier thus prepared is considered to have controlled charging quantity.

Japanese Patent 2825295 discloses a magnetic carrier which is prepared by coating core particles comprising ferromagnetic particles and hardened phenolic resin with a melamine resin. The magnetic carrier thus prepared exhibits high electric resistivity and small bulk density.

Japanese Patent 2905563 discloses a magnetic carrier which is prepared by uniformly coating core particles comprising ferromagnetic particles and hardened phenolic resin with a polyamide resin. The magnetic carrier thus prepared exhibits high electric resistivity and small bulk density.

However, the above-mentioned proposals cannot produce sufficient results contrary to expectations of low image fixing temperature and long-life carrier particles.

More specifically, in Japanese Laid-Open Patent Application 9-269614, most part of the surface of the carrier particle is occupied with the matrix resin. Therefore, it mainly depends upon the surface condition of the matrix resin whether the adhesion of toner component to the surface of the carrier particle can be prevented or not. Namely, the spent toner phenomenon cannot be always prevented from happening.

In Japanese Laid-Open Patent Application 10-198078, the same resin component as employed in the binder resin of toner composition is contained in the surface layer of the carrier particles. When the toner is designed to have a lower image-fixing temperature, the resin component common to the carrier particle and the toner particle tends to adhere to each other. The charge quantity of toner is apt to be low and unstable even at the beginning of stirring step.

The carrier in Japanese Laid-Open Patent Application 9-311505 is expected to meet both the requirements of charge imparting capability and durability to some extent by properly choosing the combination of resins for use in the surface coating layer of the carrier particles and optimizing the complex condition of the surface coating layer of the carrier particles. However, according to the proposal disclosed in the above-mentioned application, the resin composition coated on the surface of the carrier particles is homogeneous. There is no description about the microscopically observed surface condition of the carrier particles. Namely, the problem still remains that the surface condition of the carrier particles is impaired by friction between the toner particles and the carrier particles in practice. Although the composition of the surface layer of the carrier particles is specified in the application, the surface layer of the carrier particles cannot necessarily prevent the toner component from sticking to the surface of the carrier particles.

In the two-component developer, the toner particles and carrier particles are stirred together to cause triboelectric charging. However, as previously mentioned, the surface condition of the carrier particles required to impart sufficient electric charge to the toner particles, while preventing the toner component from adhering to the carrier particles has never been clarified. To satisfy both requirements, that is, to impart sufficient electric charge to toner and to extend the life of the carrier particles is still an object that has not yet been attained.

SUMMARY OF THE INVENTION

In light of the above-mentioned problems, it is a first object of the present invention to provide a carrier capable of preventing the toner component from adhering to the carrier particles and minimizing the wear of the surface layer of carrier particles. In other words, the first object is to provide a carrier having a long life, which can constantly impart sufficient electric charge to the toner particles for an extended period of time.

A second object of the present invention is to provide a two-component developer comprising the above-mentioned carrier.

A third object of the present invention is to provide a developer container.

A fourth object of the present invention is to provide an electrophotographic image forming apparatus.

The first object of the present invention can be achieved by a carrier comprising carrier particles, each carrier particle comprising a core particle comprising at least a magnetic material and a surface coating layer provided on the core particle comprising at least a resin, the surface coating layer being constituted of a plurality of regions, the regions being separately formed and joined together to form a surface complex configuration, and having different phase lags when the surface coating layer is subjected to scanning by phase imaging measurement using a scanning probe microscope in a tapping mode, wherein a region having a phase lag over the average phase lag obtained from $E_{avg}=\Sigma(E(i)\cdot S(i))/\Sigma S(i)$ has an area SO, and SO and $\Sigma S(i)$ are in a relationship of $10\% \leqq SO/\Sigma S(i)\times 100 \leqq 90\%$ when each region comprises a component A(i) having an area S(i) and a phase lag E(i), in which i represents the number of regions with different phase lags.

The second object of the present invention can be achieved by a two-component developer comprising a toner and the above-mentioned carrier, the toner comprising toner particles, each toner particle comprising a binder resin and a coloring agent.

The third object of the present invention can be achieved by a developer container which is filled with the above-mentioned two-component developer.

The fourth object of the present invention can be achieved by an electrophotographic image forming apparatus comprising the above-mentioned developer container.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
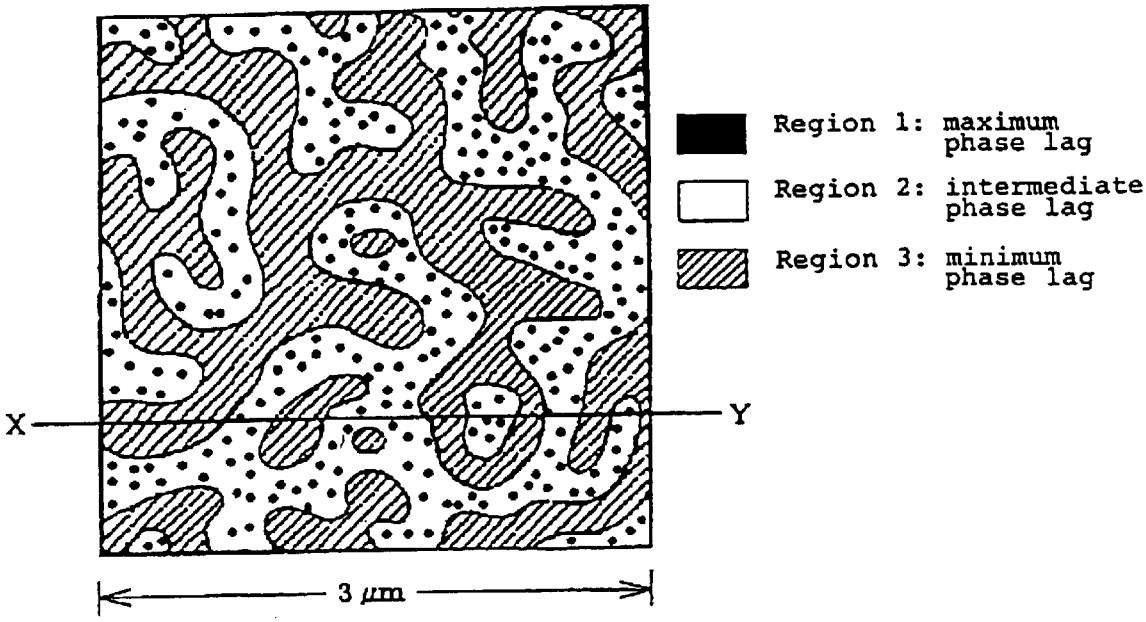
FIG. 1 is a schematic view showing the complex configuration of the surface layer of a carrier particle according to the present invention.

The carrier for use in two-component developer comprises carrier particles, which are required to impart sufficient electric charges to the toner particles, and to prevent the toner component from adhering to the surface of the carrier particles, and to prevent the carrier particles from being worn. For those purposes, it is important to optimize the composition and the surface properties such as adhesion, friction characteristics, and viscoelasticity of the carrier particles, to a degree of minute portions with which the toner particles are brought into contact to cause triboelectric charging. Namely, it is important to control the surface properties of the carrier particles so that regions with the respective surface properties are joined together to form a composite configuration in the surface coating layer of the carrier particles.

The fine composite structure formed in the surface portion or a portion adjacent thereto of the coating layer of carrier particles affects the impact and friction locally applied to the carrier particles in the stirring with the toner particles, and the impact applied to the carrier particles in the collision and the friction between the carrier particles. Depending on the above-mentioned composite structure of the surface of the carrier particles, the degree of adhesion of toner component to the surface of the carrier particles is changed, and the wearing and peeling degree of the surface layer of the carrier particles is changed. Consequently, the life of the developer, that is, the durability of the developer is drastically varied. Therefore, when the composite configuration of the coating layer of the carrier particles is properly controlled to such an extent of minute areas, the influence by the contact and friction between the toner particles and the carrier particles in the stirring operation can be sophisticatedly controlled. Thus, the above-mentioned conventional problems caused by two-component development can be solved. The inventors of the present invention has found indications of expressing the surface properties of minute portions in the surface coating layer of the carrier particles, and specified a desired range.

According to the present invention, the carrier for use with the electrophotographic process comprises carrier particles, each carrier particle comprising a core particle comprising at least a magnetic material and a surface coating layer provided on the core particle comprising at least a resin. When the surface coating layer is subjected to scanning by phase imaging measurement using a scanning probe microscope in a tapping mode, the surface coating layer is constituted of a plurality of regions, the regions being separately formed and joined together to form a composite configuration, and having different phase lags. A region formed by a component A(i) has an area S(i) and a phase lag E(i), in which i represents the number of regions with different phase lags. In the present invention, when a region having a phase lag which exceeds the average phase lag obtained from $E_{avg}=\Sigma(E(i)\cdot S(i))/\Sigma S(i)$ has an area SO, SO and $\Sigma S(i)$ are in a relationship of $10\% \leqq SO/\Sigma S(i)\times 100 \leqq 90\%$. Namely, the area SO occupies 10 to 90% of the entire surface area of the surface coating layer of the carrier particle.

In the above, Σ represents the total of all components, so that $\Sigma(E(i)\cdot S(i))=E(1)\cdot S(1)+E(2)\cdot S(2) + \ldots +E(i)\cdot S(i)$ When such a surface configuration is formed in the surface coating layer of the carrier particle as mentioned above, the carrier particles can impart sufficient electric charges to the toner particles by triboelectric charging between the carrier particles and toner particles. At the same time, adhesion of the toner component to the surface of the carrier particles, and wear of the surface coating layer of the carrier particles can be effectively inhibited.

For achieving the triboelectric charging by mixing and stirring toner particles and carrier particles together, some mechanical action, for example, contact, friction, or separation is induced between a toner charging site and a carrier charging site. The toner charging site is a surface portion or a portion adjacent thereto of the toner particle, capable of accepting the electric charge corresponding to the polarity of toner. The carrier charging site is a surface portion or a portion adjacent thereto of the carrier particle, capable of imparting the electric charge corresponding to the polarity of toner.

In the triboelectric charging system, there are several methods for smoothly delivering and accepting a large electric charge between the toner particles and the carrier particles. One is to increase the stress generated on the surface of the carrier particles when the mechanical force is exerted thereon by the friction, contact, and separation. Such a stress is hereinafter referred to as an interaction. However, if the interaction is uniformly large on the entire surface of the carrier particle, the mechanical force applied between the toner particles and the carrier particles by the friction and separation becomes larger than needed. This is because the toner particle cannot be readily separated from the carrier particle no matter where the toner particle adheres on the carrier particle. The result is that a toner component is deposited on the carrier particles, and the surface coating layer of the carrier particles is likely to wear and peel. In contrast to this, if the interaction is uniformly small overall the surface of the carrier particle, a long time is needed for the toner particles to acquire a sufficient electric charge although the adhesion of the toner component to the carrier particles and the wear and peeling of the surface layer of the carrier particles can be prevented.

According to the surface configuration defined by the present invention, there exist different regions on the surface of the carrier particle in terms of the interaction between the toner particles and the carrier particles. One region with a strong interaction can serve to efficiently impart the electric charge to the toner particles by triboelectric charging because this region can sufficiently retain the toner particles thereon. At the same time, the other region with a weak interaction has little capability of retaining the toner particles thereon, so that the toner particles cannot stay on this region of the carrier particle. Therefore, the adhesion of the toner component to the carrier particles can be prevented.

When the above-mentioned area SO occupies less than 10%, or more than 90% of the entire surface area of the carrier particle, the regions having a strong interaction and a weak interaction become too many. Under such circumstances, there occur similar phenomena as in the case where carrier particle has a homogeneous surface configuration.

It is preferable that the ratio of SO to the entire surface area of the carrier particle be in the range of 20 to 75%, more preferably 20 to 50%, to more effectively control the balance among the interaction levels on the surface coating layer of the carrier particles.

The phase lag of the above-mentioned region on the surface coating layer of the carrier particle, which is obtained by the scanning probe microscope in a tapping mode (hereinafter referred to as SPM) is a direct indication of the intensity of the interaction between the toner particles and the carrier particles. In other words, the distribution of phase lag on the surface of the carrier particle can indicate the distribution of the interaction intensity on the carrier particle. Not only the distribution, but also the area ratio of the region with a strong interaction or the region with a weak interaction can be observed by the SPM.

The phase lag distribution on the surface of the carrier particle can be measured by the following method.

Sample carrier particles covered with a surface coating layer were fixed on a rigid support with a double-coated adhesive tape or an adhesive when necessary. The support which bears the sample carrier particles thereon is set at the measuring position of the SPM under the circumstances of room temperature and normal pressure. The surface of the sample carrier particle is subjected to scanning within the scanning range of about 2 to 200 $\mu$m as the probe is caused to vibrate at a resonant frequency. Such a scanning mode is called the tapping mode. In this case, the curvature radius of the tip of the probe is about 5 to 20 nm, and the tapping frequency is preferably about 150 to 450 kHz.

The phase lag in an alternating current signal output by the scanning in a tapping mode with respect to the alternating current signal input to vibrate the probe is detected to measure the phase lag. By measuring the phase lag at each of the scanning points, the distribution in phase lag can be indicated within the scanning range. A large phase lag is detected at a region with a strong interaction, whereas a small phase lag is detected at a region with a weak interaction.

The materials for the carrier of the present invention are not particularly limited. For example, as the core material for each carrier particle, there can be employed magnetic particles made of metals such as iron, cobalt, and nickel, and alloys and compounds such as magnetite, hematite, and ferrite. Those magnetic particles may be single crystal particles and/or amorphous particles. The magnetic particles may be particles of a sintered product of a single substance or composite material, or dispersing the above-mentioned particles in a polymeric material such as a resin. When the core particles are prepared by dispersing magnetic particles in a polymeric material, the magnetic particles with a particle size of about 0.5 to 10 $\mu$m are preferable in light of both requirements, that is, the magnetic characteristics of the obtained carrier particles and the dispersion properties of the magnetic particles.

Examples of the resin for use in the core particles and/or the surface coating layer provided on the core particles are as follows: polyolefin resins such as polyethylene, polypropylene, chlorinated polyethylene, and chlorosulfonated polyethylene; polyvinyl and polyvinylidene resins such as polystyrene, acryl, for example, poly(methyl methacrylate), polyacrylonitrile, poly(vinyl acetate), poly(vinyl alcohol), poly(vinyl butyral), poly(vinyl chloride), poly(vinylcarbazole), poly(vinyl ether), and poly(vinyl ketone); vinyl chloride-vinyl acetate copolymer; silicone resin having organosiloxane bond, which silicone resin may be modified with alkyd resin, polyester resin, epoxy resin, and polyurethane resin; perhydropolysilazane which may be modified or partially oxidized; fluorine-containing resins such as polytetrafluoroethylene, poly(vinyl fluoride), and polychlorotrifluoroethylene; polyamide, polyester; polyurethane; polycarbonate; urea resin; melamine resin; benzoguanamine resin; and epoxy resin.

In particular, as the resin material for use in the surface coating layer, there are preferably employed a composite resin of silicone resin and polyethyleneimine, a composite resin of silicone resin and polyolefin resin, and a composite resin of perhydropolysilazane resin and polyolefin resin. Of these composite resins, the composite resin of silicone resin and polyethyleneimine resin is preferred in the present invention.

When the above-mentioned composite resin are used for the preparation of the surface coating layer of the carrier particles, the resin components used for the composite resin may be modified so as to be partially compatible with each other. Alternatively, part of one resin component may be chemically bonded to the other resin component to produce a block polymer, graft polymer, or an intermediate product thereof. In such a case, it is preferable that the polymer be produced by cross-linking reaction in the course of the preparation of the surface coating layer.

It is preferable that the surface coating layer of the carrier particle comprise a silicone resin having a siloxane bond.

As the above-mentioned silicone resin, there are conventionally known silicone resins, for example, a straight silicone resin constructed only by organosiloxane bond, represented by the following formula, and alkyd-, polyester-, epoxy-, or urethane-modified silicone compound.

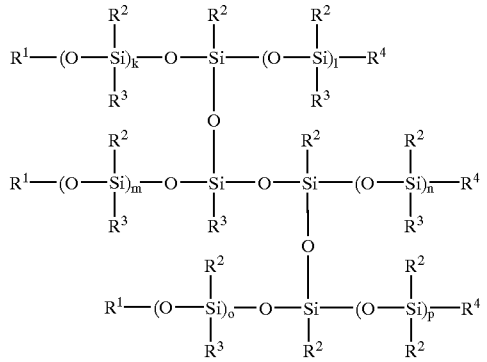

wherein $R^1$ is a hydrogen atom, an alkyl group having 1 to 4 carbon atoms, or phenyl group; $R^2$ and $R^3$ are each a hydrogen group, an alkoxyl group having 1 to 4 carbon atoms, phenyl group, phenoxy group, an alkenyl group having 2 to 4 carbon atoms, an alkenyloxy group having 2 to 4 carbon atoms, hydroxyl group, carboxyl group, ethyleneoxide group, glycidyl group, or

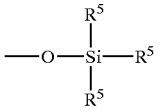

in which $R^4$ and $R^5$ are each hydroxyl group, carboxyl group, an alkyl group having 1 to 4 carbon atoms, an alkoxyl group having 1 to 4 carbon atoms, an alkenyl group having 2 to 4 carbon atoms, an alkenyloxy group having 2 to 4 carbon atoms, phenyl group, or phenoxy group; and k, l, m, n, o, and p are each an integer of 1 or more.

In the above formula, $R^1$ to $R^5$ may have a substituent such as amino group, hydroxyl group, carboxyl group, mercapto group, an alkyl group, phenyl group, ethyleneoxide group, glycidyl group, or a halogen atom.

It is also preferable that the surface coating layer of the carrier particle comprise a silicone resin having a polysilazane skeleton.

As the above-mentioned perhydropolysilazane, there can be used not only the conventionally known unsubstituted perhydropolysilazane, but also partially substituted polysilazane, that is, having a substituent such as an alkyl group, phenyl group, an alkylphenyl group, or an alkenyl group, each of which may be halogenated, and in addition, sulfo group, phosphino group, or phosphinyl group. In addition to the above, composite polymers including the above-mentioned compounds are usable.

In the preparation of the core particles and/or surface coating layer provided on the core particles, the electric resistance of the above-mentioned resin materials may be controlled by dispersing fine particles with low electrical resistivity. For example, metals such as iron, gold, and copper; iron oxide such as ferrite and magnetite; and pigments such as carbon black are conventionally used to control the electrical resistance of the resin materials.

In particular, a mixture of furnace black and acetylene black, each being a kind of carbon black, is preferably used as the agent for controlling the electric resistance of the resin material. By the addition of a small amount of the mixture of furnace black and acetylene black, the electroconductivity of the resin material can be effectively adjusted. The above-mentioned fine particles with low resistivity have preferably a particle size of about 0.01 to 10 $\mu$m. When those particles are contained in the resin material, it is preferable that the low-resistivity fine particles be added in an amount of 2 to 30 parts by weight, more preferably 5 to 20 parts by weight, to 100 parts by weight of the resin material for preparation of the core particles or surface coating layer therefor.

Furthermore, a coupling agent such as silane coupling agent or titanium coupling agent may be added as an assistant to the resin material for use in the core particles and/or the surface coating layer of the carrier particles in order to improve the adhesion therebetween and the dispersion properties of the above-mentioned resistivity controlling fine particles.

One example of the silane coupling agent for use in the present invention is represented by formula of $YRSiX^3$, in which $X^3$ is a hydrolyzable group bonded to silicon atom, such as a chloro group, alkoxyl group, acetoxy group, alkylamino group, or propenoxy group; Y is an organic functional group reactive with an organic matrix, such as vinyl group, methacryl group, epoxy group, glycidoxy group, amino group, or mercapto group; and R is an alkyl group having 1 to 20 carbon atoms or an alkylene group.

To obtain a negative developer, an amino silane coupling agent in which Y is amino group in the above formula is preferable. On the other hand, an epoxy silane coupling agent wherein Y represents epoxy group is preferably employed to obtain a positive developer.

To prepare the carrier particles of the present invention, a liquid for forming the surface coating layer is coated on the surface of the core particles by spray coating, dip coating, or the like. For instance, it is preferable that the surface coating layer formation liquid comprising a resin composition and a solvent be coated on the core particles comprising at least a magnetic material with the application of heat thereto. In this case, the solvent component in the surface coating layer formation liquid is removed therefrom in the course of coating operation, whereby the resin component can be securely fixed to the surface of the core particles. After completion of the coating step, the surface-layer-coated core particles may be dried at a temperature higher than that employed in the coating step. By following the above-described procedure for preparation of the carrier particles, the resin composition contained in the surface coating layer formation liquid can homogeneously form a composite structure so that the obtained surface coating layer can satisfy the conditions of the present invention.

It is preferable that the surface coating layer thus provided around the core particles have a thickness of 0.1 to 20 $\mu$m.

In the carrier of the present invention, when the surface coating layer comprises a component $A_{min}$ having a minimum phase lag $E_{min}$ and forming a region with an area $S_{min}$, it is preferable that the relationship of $S_{min}/\Sigma S(i)\times 100 \leqq 80\%$ be satisfied.

To achieve a better balance among the various regions with different interactions on the surface coating layer of the carrier particle, it is preferable that the area ratio of the surface region of which the level of interaction is minimum be 80% or less of the entire surface area of the carrier particle. When the above-mentioned area ratio exceeds 80%, the probabilities of bringing the toner particles in contact with the surface region having the minimum interaction are undoubtedly too high. As a result, it takes a long time until the charge quantity of toner attains to a stable level. In other words, the rise of charging performance of toner is delayed.

In the carrier of the present invention, it is preferable that when the surface coating layer comprises a component $A_{max}$ having a maximum phase lag $E_{max}$ and forming a region with an area $S_{max}$, the relationship of $S_{max}/\Sigma S(i)\times 100 \leqq 60\%$ be satisfied. Namely, it is preferable that the area ratio of the surface region of which the level of interaction is maximum be 60% or less of the entire surface area of the carrier particle. When the area ratio of the surface portion $S_{max}$ exceeds 60%, the probabilities of bringing the toner particles in contact with the surface region of which the level of interaction is the highest are undoubtedly too high. As a result, the charging stability cannot be maintained with time. Further, when the area ratio of the surface region $S_{max}$ is 45% or less, more preferable results can be obtained.

Further in the present invention, it is preferable that the above-mentioned minimum phase lag $E_{min}$ and maximum phase lag $E_{max}$ be in a relationship of $0.2 \leqq E_{min}/E_{max} \leqq 0.7$.

When the value of $E_{min}$ is far apart from the value of $E_{max}$, that is, $E_{min}/E_{max}<0.2$, the interactions as a whole on the surface coating layer is unfavorably changed depending upon a slight change in the manufacturing conditions. The carrier particles of the present invention cannot be stably produced.

In contrast to the above, when the value of $E_{min}$ is close to the value of $E_{max}$, that is, $E_{min}/E_{max}>0.7$, the obtained composite surface configuration of the carrier particles becomes ambiguous. By such a design of composite surface configuration of the carrier particles, it is difficult to meet both requirements, that is, smooth charging of toner particles and extension of the life of carrier particles.

The interaction level of the carrier particle with the toner particle, which depends on the kind of toner particle, and the employed two-component development process, cannot be unconditionally determined. Therefore, when the values of $E_{min}$ and $E_{max}$ are used as the relative indications, the above-mentioned preferable condition of $0.2 \leqq E_{min}/E_{max} \leqq 0.7$, more preferably $0.25 \leqq E_{min}/E_{max} \leqq 0.5$, may be satisfied.

When the surface coating layer of the carrier particle comprises a component $A_{mod}$ forming a region which occupies a maximum area $S_{mod}$ in the entire surface area $\Sigma S(i)$, it is preferable that $S_{mod}$ and $\Sigma S(i)$ be in a relationship of $S_{mod}/\Sigma S(i)\times 100 \leqq 80\%$.

As mentioned above, the functions of the carrier particles are controlled by composing of minute surface regions with different levels of interaction and adjusting the condition of the thus formed composite surface configuration. Therefore, when the area ratio of a surface region with the identical level of interaction is more than 80% of the entire surface area of the carrier particle, there is the possibility that other regions with different levels of interaction cannot exhibit their functions. In view of this point, it is preferable that the condition of $S_{mod}/\Sigma S(i)\times 100 \leqq 80\%$, more preferably, $S_{mod}/\Sigma S(i)\times 100 \leqq 60\%$ be satisfied.

When a segment with a length of 2 $\mu$m is arbitrarily drawn in a phase imaging picture taken by the SPM in such a way that part of the segment overlaps the region formed by the component $A_{mod}$, it is preferable that the segment stretch over at least part of the region formed by the component $A_{mod}$ and at least a part of any region other than the region formed by the component $A_{mod}$.

On the surface of the carrier particle, a region with a high interaction level and a region with a low interaction level are joined together so as to form a complex surface configuration. Without control of the condition of the complex surface configuration, in particular, the balance of the surface region occupying the maximum area with other surface regions, there is the risk that each region merely exhibits its own function.

To maximize the effect of the present invention, it is effective that the composing of the surface region occupying the maximum area be sophisticatedly controlled. If the region formed by the component $A_{mod}$ or any of other regions independently extends for 2 $\mu$m or more, only such a region becomes relevant to the contact with the toner particle when the toner particles are stirred together with the carrier particles in practice. When the region formed by the component $A_{mod}$ or any of other regions does not extend for 2 $\mu$m or more, any contact portion on the surface of the carrier can be provided with a sufficiently composite configuration. As a result, even if the toner particles come in contact with any surface portions of the carrier particles, the toner particles are in contact with the carrier particles under substantially the same condition, and the triboelectric charging therebetween is constant. In light of this point, the requirements to impart sufficient electric charge to the toner particles and to extend the life of the carrier particles can be both satisfied more efficiently.

As another indication of the degree of complexity of the surface configuration, it is preferable that the boundary between the region formed by $A_{mod}$ and the adjacent regions thereto show a fractal dimension of 1.1 to 1.6.

The above-mentioned fractal dimension is generally given as an indication of the complexity of a curve or the like. When the boundary between the adjacent regions on the surface of the carrier particle is expressed by the fractal dimension, it can be understood how complicated the boundary is. In other words, the degree of complexity of the surface composite configuration of the carrier particle can be determined.

When the fractal dimension is lower than 1.1, it is not considered that the sufficiently composite configuration is formed at each surface portion on the carrier particle. The result is that the interaction of each region independently works. In particular, the deposition of toner component to the carrier particles cannot be inhibited for an extended period of time at the region with a relatively strong interaction.

On the other hand, when the fractal dimension exceeds 1.6, the surface composite configuration of the carrier particle becomes too complex, so that the surface coating layer exhibits substantially the same behavior as that of a surface layer made of a single phase. The effect resulting from the composite surface configuration cannot be obtained.

The fractal dimension of the boundary between the region formed by the component $A_{mod}$ and any other adjacent regions is obtained, for example, by the following methods.

A region formed by the component $A_{mod}$ is identified by measuring the area of every region observed in a picture showing the phase lag distribution taken by the SPM, as shown in FIG. 1. Only the boundary between the region of the component $A_{mod}$ and the adjacent regions thereto is extracted by image processing. A set of segments with the same length are arranged along the boundary so as to approach the shape the boundary. Various kinds of sets of segments are used to shape the boundary. Values for the length of the segment and the number of segments included in the set are plotted in logarithmic form. From the gradient of the graph, the fractal dimension can be obtained.

Alternatively, the fractal dimension can also be determined from the correlation dimension. Only the boundary between the region of the component $A_{mod}$ and the adjacent regions thereto is extracted by image processing. A number of dots (total number (N)) are put on the boundary. A circle with radius (r) is drawn round one of the dots. The number of dots disposed within the circle is counted. The above-mentioned steps are repeated in the same manner with respect to all the dots, and the dots disposed within the circles are added up. The total number of dots thus added up is divided by N squared, and the obtained quotient is designated by C(r).

This procedure is similarly repeated with the radius (r) being variously changed. The fractal dimension (correlation dimension) is obtained from the gradient of the log r vs. log C(r) plots.

To prevent the toner component from adhering to the surface of the carrier particles, it is preferable that the region with a relatively weak interaction and/or the region which occupies a maximum area in the entire surface area of the carrier particle comprise silicon atom.

To impart the electric charge to the toner particles with no difficulty, it is preferable that the region with a relatively strong interaction and/or the region which occupies a maximum area in the entire surface area of the carrier particle comprise nitrogen atom.

Furthermore, in the present invention, it is preferable that any region of the surface coating layer on the carrier particle comprise a siloxane bond. Any region may have a structure with a polysilazane skeleton. When the composite surface configuration of the surface coating layer of the carrier particle comprises the above-mentioned siloxane bond, and polysilazane skeleton, the surface of the carrier particles can be made apparently uniform, and microscopically provided with a sophisticatedly composite configuration with high strength and toughness.

The present invention also provides an electrophotographic developer comprising the above-described carrier and a toner comprising toner particles, each toner particle comprising a binder resin and a coloring agent.

The toner particles for use in the present invention are not particularly limited, and conventional toner particles for use with the electrophotographic process are available.

Examples of the binder resin contained in the toner particles for use in the present invention are as follows: homopolymers of styrene and substituted styrenes such as polystyrene, poly-p-chlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene-acrylonitrile copolymer, styrene-vinylmethyl ketone copolymer, styrene-butadiene copolymer, styrene-isoprene copolymer, and styrene-maleic acid copolymer; acrylic ester-based homopolymers and copolymers such as poly(methyl acrylate), poly(butyl acrylate), poly(methyl methacrylate), and poly(butyl methacrylate); polyvinyl derivatives such as poly(vinyl chloride) and poly(vinyl acetate); polyester-based polymers; polyurethane-based polymers; polyamide-based polymers; polyimide-based polymers; polyol-based polymers; epoxy-based polymers; terpene-based polymers; aliphatic or alicyclic hydrocarbon resins; and aromatic petroleum resins.

Those resins may be used alone or in combination. In particular, when the binder resin comprises at least one resin component selected from the group consisting of a styrene-acrylic copolymer resin, a polyester-based resin, and a polyol-based resin, the obtained toner particles are advantageous from the viewpoints of electrical characteristics and manufacturing cost.

Further, for obtaining better fixing properties, it is further preferable to employ the polyester-based resin and/or polyol-based resin for the binder resin of the toner particles.

The coloring agent for use in the toner includes various pigments and dyes conventionally employed in the electrophotographic toner.

Specific examples of the coloring agent are carbon black, lamp black, iron black, ultramarine blue, nigrosine dye, Aniline Blue, Phthalocyanine Blue, Phthalocyanine Green, Hansa Yellow G, Rhodamine 6C lake, Chalco Oil Blue, Chrome Yellow, quinacridone red, Benzidine Yellow, and Rose Bengale.

Those coloring agents may be used alone or in combination.

In the case where the toner particles are provided with magnetic properties, the toner particles may comprise a magnetic component. Examples of the magnetic component are iron oxides such as ferrite, magnetite, and maghemite, metals such as iron, cobalt, and nickel, and alloys comprising any of the above-mentioned metals.

Those magnetic components may be used alone or in combination. Further, such a magnetic component can also serve as the coloring agent.

When the toner is fixed to an image receiving member by an oil-less fixing method, that is, a releasant such as an oil is not used in the toner image fixing step, the toner particles may comprise a variety of waxes such as polyethylene wax, propylene wax, and carnauba wax. In this case, the amount of the wax, which depends on the kinds of materials constituting the toner and the image fixing method, is preferably in the range of about 0.5 to 10.0 wt. %, more preferably about 3.0 to 8.0 wt. %, of the total weight of the toner particles.

In addition to the above, the toner may further comprise a charge control agent to improve the rise of charging performance.

Specific examples of the charge control agent include positive charge control agents such as amino-group-containing vinyl-based copolymer, quaternary ammonium salt compound, nigrosine dye, polyamine resin, imidazole compound, azine dye, triphenylmethane dye, guanidine compound, and lake pigment; and negative charge control agents such as carboxylic acid derivative and metal salts thereof, alkoxylate, organic metallic complex compound, and chelate compound.

The above-mentioned conventional charge control agent, which may be used alone or in combination, is kneaded with other materials in the course of preparation of toner particles, and/or externally added to the obtained toner particles. When fine particles of the charge control agent are dispersed in the toner particles, it is preferable that the charge control agent particles have a particle size of 2.0 $\mu$m or less, more preferably 1.0 $\mu$m or less in light of uniform interaction between the toner particles and the carrier particles.

Furthermore, the toner may further comprise an additive for enhancing the fluidity of toner particles and improving the environmental dependence of toner particles. For this purpose, finely-divided particles of inorganic materials such as zinc oxide, tin oxide, aluminum oxide, titanium oxide, silicon oxide, strontium titanate, barium titanate, calcium titanate, strontium zirconate, calcium zirconate, lanthanum titanate, calcium carbonate, magnesium carbonate, mica, and dolomite are preferably used alone or in combination. Those particles may be treated to be hydrophobic.

In addition, finely-divided particles of fluoro-containing resins such as polytetrafluoroethylene, tetrafluoroethylene-hexafluoropropylene copolymer, and poly(vinylidene fluoride) may be used as a modifier for the surface properties of the toner particles.

Although the amount of the above-mentioned fluidity imparting agent or surface modifier depends upon the kind of agent, such an additive may be externally added in an amount of about 0.1 to 10 parts by weight to 100 parts by weight of the toner matrix particles. The finely-divided particles of the fluidity imparting agent and surface modifier may be mixed with toner matrix particles in a mixer when necessary so that the finely-divided particles of the above-mentioned agent may be externally added or attached to the surface of the toner particles. Alternatively, the above-mentioned agent may be used in such a fashion that the finely-divided particles of the agent are disposed in the free state between the toner particles.

The toner for use in the two-component developer of the present invention can be prepared by sufficiently mixing and kneading the above-mentioned binder resin, coloring agent, charge control agent, and other additives by the conventional method, using a two-roll mixer, a double screw extruder, or a single screw kneader.

For instance, the kneaded mixture is then pulverized by means of a mechanical pulverizer, and classified using jet air stream, thereby preparing toner matrix particles. In the course of kneading, a dispersant may be used to control the dispersed condition of the coloring agent and the magnetic material. The toner matrix particles thus prepared may be subjected to surface modification by mixing with the above-described agents using a mixer.

The charge quantity of toner cannot be definitely determined because it depends upon the employed process in practice. In the present invention, it is preferable that the saturated charge quantity of toner be in the range of about 3 to 40 $\mu$C/g, more preferably in the range of 5 to 30 $\mu$C/g in terms of the absolute value when the toner is used in combination with the carrier according to the present invention.

In the two-component developer of the present invention, it is preferable that the toner particles comprise toner particles with a particle diameter of 2.5 $\mu$m or less with a content ratio of 10% or less by number.

As previously explained, the object of the present invention is directed to the control of the interaction between toner particles and carrier particles, that is, contact, friction, and separation at the surface coating layer. If the toner comprises a large amount of toner particles with extremely small particle size, such small toner particles are apt to be deposited on the surface region of the carrier particle with a relatively high level of interaction. Those toner particles tend to adhere to the carrier particles for an extended period of time.

Therefore, it is preferable to minimize the number of toner particles with extremely small particle size when the electrophotographic developer employs the carrier of the present invention.

The present invention also provides a developer container which is filled with the above-described two-component developer for use with the electrophotographic process, and an electrophotographic image forming apparatus with the above-mentioned developer container.

The surface configuration of the carrier particles according to the present invention will now be explained in detail with reference to FIG. 1 to FIG. 4.

FIG. 1 is a schematic view showing one embodiment of a complex surface configuration of the carrier particle according to the present invention. In this embodiment, there are three regions 1, 2 and 3 with different levels of interaction, in other words, with different phase lags.

Figure 2:
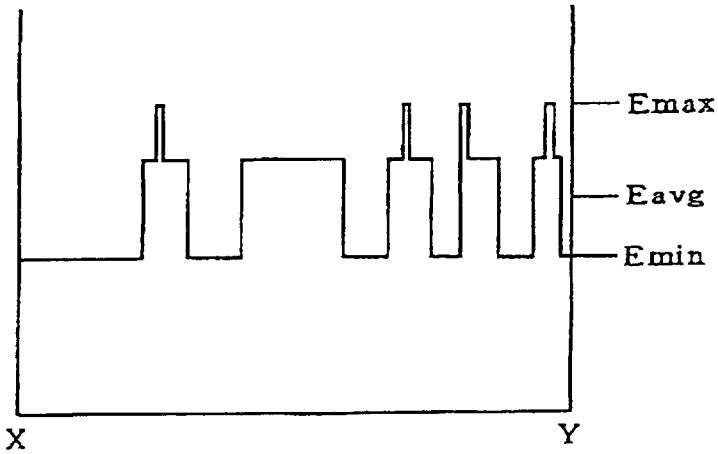
FIG. 2 is a graph showing the distribution of phase lag in the complex surface portion of the carrier particle taken along the line X-Y of FIG. 1.

FIG. 2 is a graph showing the distribution of phase lag of a surface portion taken along the line X-Y of FIG. 1.

As can be seen from FIG. 1 and FIG. 2, the phase lag of the region 1 indicated by a solid portion is maximum ($E_{max}$), the phase lag of the region 3 indicated by a shaded portion is minimum ($E_{min}$) and the phase lag of the region 2 indicated by a blank portion is intermediate. In FIG. 2, the average phase lag represented by $E_{avg}$ is calculated in light of the area occupied by each region.

In the embodiment of FIG. 1, the region 3 occupies the maximum area of the entire surface area, and the component constituting the region 3 is regarded as $A_{mod}$ Further, when a segment with a length of 2 $\mu$m is arbitrarily drawn in this picture of FIG. 1 so that the segment overlaps a part of the region 3, the segment stretches over the region 3 and the region 1 and/or 2.

Figure 3:
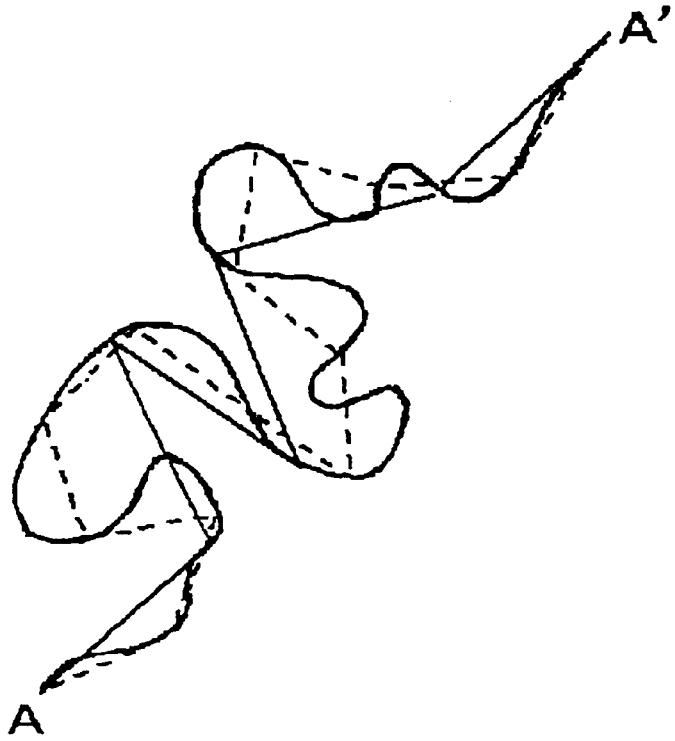
FIG. 3 is a schematic view in explanation of the method for obtaining the fractal dimension of the boundary between adjacent regions in the surface coating layer of the carrier.
Figure 4:
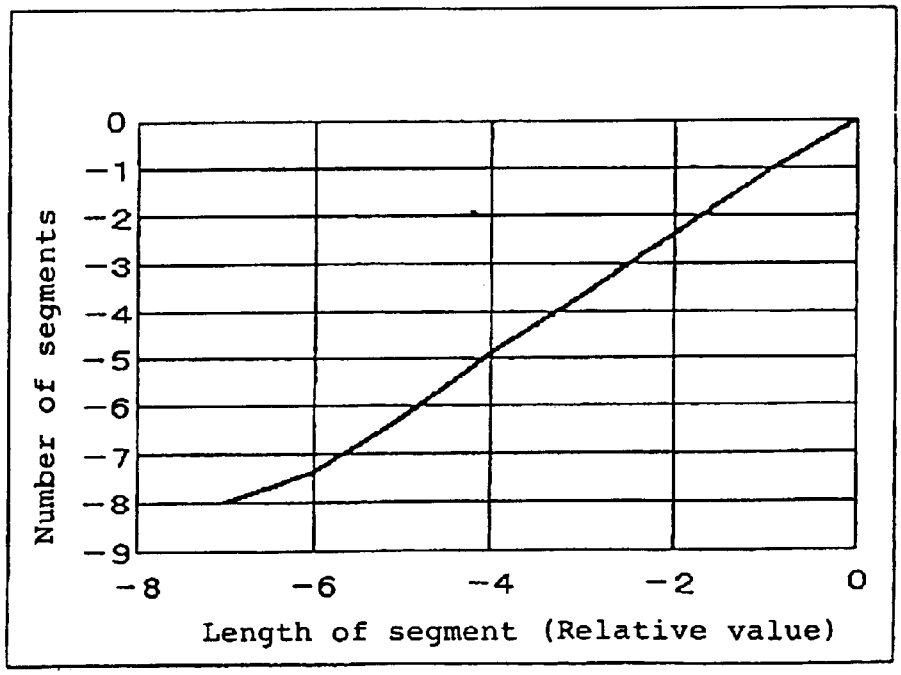
FIG. 4 is a graph showing one example of the fractal dimension.

FIG. 3 is a schematic view in explanation of one of the methods for obtaining the fractal dimension. A curved line A–A' represents a boundary between the region formed by a component $A_{mod}$ and the adjacent regions thereto. A set of segments with the same length represented by solid lines are connected along the curve A–A' so as to approach the shape of the curve. Another set of segments with the same length represented by broken lines are also joined together along the curve A–A'. The length of the broken line segment is half the length of the solid line segment. The curve A–A' is similarly partitioned by other sets of segments with different lengths. The value for the length of a set of segments (in terms of a relative value when the distance of A–A' is supposed to be 1) and the value for the number of segments included in the set are plotted in logarithmic form, so that a graph as shown in FIG. 4 is obtained. From the gradient of this graph, the fractal dimension of the curve A–A' can be obtained.

Other features of this invention will become apparent in the course of the following description of exemplary embodiments, which are given for illustration of the invention and are not intended to be limiting thereof.

EXAMPLE 1

[Preparation of Carrier Particles]

<Composition of Surface Coating Layer Formation Liquid>

| | Parts by Weight |
|---|---|
| Dimethoxysilicone · polyethyleneimine composite resin (3:1 by molar ratio) | 10 |
| Ethanol | 100 |

The above-mentioned surface coating layer formation liquid was coated on the surface of spherical ferrite particles with a weight average particle size of 50 $\mu$m by fluidized bed spray coating at 60° C. and dried with the application of heat thereto. The surface coating layer with a thickness of about 1 $\mu$m was coated on the core ferrite particles. Thereafter, the coated ferrite particles were sintered at 160° C. in the atmosphere for 90 minutes using an electric furnace.

Thus, there was provided a carrier comprising carrier particles No. 1 according to the present invention.

[Preparation of Toner Particles]

The following components were sufficiently mixed:

| | Parts by weight |
|---|---|
| Polyester resin (condensation product of bisphenol A - ethylene oxide adduct alcohol, bisphenol A - propylene oxide adduct alcohol, terephthalic acid, and trimellitic acid) Mw = about 12,000, glass transition point = about 60° C. | 79 |
| Carbon black (Trademark "#44", made by Mitsubishi Chemical Corporation) | 15 |
| Chromium-containing dye (charge control agent) (Trademark "AIZON SPILON BLACK TRH", made by Hodogaya Chemical Co., Ltd. | 1 |
| Carnauba wax (made by Noda Wax Co., Ltd.) | 5 |

The resultant mixture was kneaded for 30 minutes using a two-roll kneader. The mixture was pulverized using a mechanical pulverizer, and subjected to air classification, so that toner matrix particles were prepared.

100 parts of the above prepared toner matrix particles and one part of finely-divided particles of hydrophobic silica surface-treated with dimethylsilane were mixed for 2 minutes in a Henschel mixer. Thus, toner particles No. 1 for use in the present invention were obtained.

The particle size distribution of the toner particles No. 1 was measured by use of "Coulter Counter Model TAII" (made by Coulter Electronics Limited). The result was that the weight average particle size of the toner particles was 6.5 $\mu$m, and the number average particle size calculated from a cumulative undersize particle number distribution when the toner particles reach a cumulative particle number of 10% in the cumulative undersize particle number distribution was 2.8 $\mu$m.

With respect to the phase imaging measurement of the surface coating layer of the carrier particles, a commercially available scanning probe microscope system "Mano-ScopeIIIa" with a microscope "Dimension 3100", and a phase detection extender module "PHASE-D01", made by Digital Instruments were employed.

More specifically, a sample of carrier particles was fastened to an aluminum plate with an adhesive. With the scanning range being set to a 5 $\mu$m×5 $\mu$m square, the measurement was carried out at three points on the sample. Using the data obtained, each of the values specified in the present invention was determined as the average obtained at the three points.

Then, a segment with a length of 2 $\mu$m was arbitrarily drawn in the picture taken by the microscope. It was visually confirmed whether the segment stretches over both the region formed by the component $A_{mod}$ and any other adjacent regions.

Subsequently, the boundary between the region formed by the component $A_{mod}$ and any other region adjacent thereto was extracted. The fractal dimension of the boundary was obtained in the above-mentioned manner using five sets of segments with different lengths. The values for the length of a segment and the number of segments included in a set were plotted in logarithmic form. From the gradient of the graph, the fractal dimension was obtained.

Further, to evaluate the charge imparting performance of the carrier particles, the toner particles No. 1 and the carrier particles No. 1 obtained in Example 1 were stirred to conduct a test for evaluating the rise in charging of toner. In this test, the carrier particles and the toner particles were mixed at a ratio by weight of 95:5, and stirred for 10 sec., 60 sec., and 600 sec.

The charge quantity of toner was measured by a blow-off method. To be more specific, the charge quantity of toner was measured by separating the toner particles from the carrier particles by air blow, using a commercially available electrometer (Trademark "610C", made by Kethley Instruments, Inc.).

In addition, for the evaluation of the image quality, a two-component developer consisting of the carrier particles No. 1 and the toner particles No. 1 was incorporated into a commercially available copying machine (Trademark "imagio MF-6550", made by Ricoh Company, Ltd.), which was partially modified.

More specifically, a running test was carried out by continuously making 300,000 copies through an original (A4 size) with an image occupying ratio of 6%. A character image was evaluated in terms of fogging of the background, and a solid image was evaluated in terms of the stability of image density at the initial stage and after making of 300,000 copies. The image density was measured using a Macbeth densitometer "RD-914", and the fogging and other drawbacks were visually inspected.

A latent electrostatic image formed on the image-bearing member was charged in such a manner that the background portion was charged to −700 V, and the image portion was charged to −200 V. A direct current developing bias voltage was applied to the development sleeve.

After the completion of making of 300,000 copies, the two-component developer was taken out of the copying machine. The toner particles attached to the surface of carrier particles were blown away by air blow method. Thereafter, the carrier particles in a predetermined amount were dispersed in toluene, and the supernatant liquid was collected from the dispersion. The toner component which had not been removed from the carrier particles by the air blow method and remained sticking to the surface of the carrier particles was dissolved in toluene. The white visible light transmission of the supernatant liquid was measured. For reference, the carrier particles No. 1 not subjected to copying operation were similarly dispersed in toluene, and the reference white visible light transmission was obtained. The degree of deposition of toner component to the carrier particles was relatively expressed as the difference between the white visible light transmission of the carrier particles subjected to the running test and the reference white visible light transmission. The transmission was measured using a commercially available spectrophotometer (Trademark "TC-1800" made by Tokyo Denshoku Co., Ltd.) equipped with a light source C50.

Furthermore, after the completion of making of 300,000 copies, the degree of wear of the surface coating layer for use in the carrier particles was evaluated. To be more specific, the degree of peeling of the surface coating layer from the core particles was examined by X-ray fluorescence analysis using a commercially available X-ray fluorescence spectrometer "ZSX100e" made by Rigaku Industrial Corporation. For this evaluation, the X-ray intensity from a particular element was simultaneously measured using three samples, that is, the core particles free from the surface coating layer, the carrier particles No. 1 not subjected to the running test, and the carrier particles No. 1 subjected to the running test. The remaining amounts (X1), (X2), and (X3) of the particular element were respectively obtained from the three samples. The degree of wear of the surface coating layer was calculated in accordance with the following formula:

$$\text{Degree of wear } (\%)=(X3-X2)/(X2-X1)\times 100$$

As the above-mentioned particular element for measurement, silicon atom was used when contained in the surface coating layer, otherwise carbon atom was used.

As a result, the carrier particles No. 1 were evaluated as excellent because the charging performance did not deteriorate after continuous copying operation, so that high quality images were maintained. The wear of the surface coating layer and the deposition of toner component to the carrier particles were remarkably slight.

The results of the phase imaging measurement and the evaluation results are respectively shown in TABLE 1 and TABLE 2.

EXAMPLE 2

The procedure for preparation of the carrier particles No. 1 in Example 1 was repeated except that the sintering of the carrier core particles coated with the surface coating layer was carried out at 200° C. for 30 minutes so as to adjust the surface configuration of the carrier particles. Thus, a carrier comprising carrier particles No. 2 according to the present invention was obtained.

The results of the phase imaging measurement are shown in TABLE 1.

The evaluation tests were carried out in the same manner as in Example 1. The evaluation results are shown in TABLE 2.

As a result, the carrier particles No. 2 were evaluated as excellent because the charging performance did not deteriorate after the continuous copying operation, so that high quality images were maintained. The wear of the surface coating layer and the deposition of toner component to the carrier particles were remarkably slight.

EXAMPLE 3

[Preparation of Carrier Particles]

<Composition of Surface Coating Layer Formation Liquid>

| | Parts by Weight |
|---|---|
| Polysilazane | 7 |
| Butyl methacrylate | 3 |
| Carbon black | 1 |
| Toluene | 100 |

The above-mentioned surface coating layer formation liquid was coated on the surface of spherical ferrite particles with a weight average particle size of 50 μm by fluidized bed spray coating at 90° C. and dried with the application of heat thereto. The surface coating layer with a thickness of about 1 μm was coated on the core ferrite particles. Thereafter, the coated ferrite particles were sintered at 200° C. in the atmosphere for 30 minutes using an electric furnace.

Thus, a carrier comprising carrier particles No. 3 according to the present invention was obtained.

The results of the phase imaging measurement are shown in TABLE 1.

The evaluation tests were carried out in the same manner as in Example 1. The evaluation results are shown in TABLE 2.

As a result, the carrier particles No. 3 were evaluated as excellent because the charging performance did not deteriorate after the continuous copying operation, so that high quality images were maintained. The wear of the surface coating layer and the deposition of toner component to the carrier particles were remarkably slight.

EXAMPLE 4

[Preparation of Carrier Particles]

<Composition of Surface Coating Layer Formation Liquid>

| | Parts by Weight |
|---|---|
| Polyimide | 5 |
| Acrylic resin | 5 |
| Carbon black | 1 |
| Toluene | 100 |

The above-mentioned surface coating layer formation liquid was coated on the surface of spherical ferrite particles with a weight average particle size of 50 μm by fluidized bed spray coating at 90° C. and dried with the application of heat thereto. The surface coating layer with a thickness of about 1 μm was coated on the core ferrite particles. Thereafter, the coated particles were sintered at 250° C. in the atmosphere for 90 minutes using an electric furnace.

Thus, a carrier comprising carrier particles No. 4 according to the present invention was obtained.

The results of the phase imaging measurement are shown in TABLE 1.

The evaluation tests were carried out in the same manner as in Example 1. The evaluation results are shown in TABLE 2.

As a result, the carrier particles No. 4 were evaluated as excellent because the charging performance did not deteriorate after the continuous copying operation, so that high quality images were maintained. The wear of the surface coating layer and the deposition of toner component to the carrier particles were remarkably slight.

EXAMPLE 5

The procedure for preparation of the carrier particles No. 1 in Example 1 was repeated except that the sintering of the carrier core particles coated with the surface coating layer was carried out at 120° C. for 90 minutes so as to adjust the surface configuration of the carrier particles. Thus, a carrier comprising carrier particles No. 5 according to the present invention was obtained.

The results of the phase imaging measurement are shown in TABLE 1.

The evaluation tests were carried out in the same manner as in Example 1. The evaluation results are shown in TABLE 2.

As a result, the carrier particles No. 5 were evaluated as excellent because the charging performance did not deteriorate after the continuous copying operation, so that high quality images were maintained. The wear of the surface coating layer and the deposition of toner component to the carrier particles were remarkably slight.

EXAMPLE 6

[Preparation of Carrier Particles]

<Composition of Surface Coating Layer Formation Liquid>

| | Parts by Weight |
|---|---|
| Dimethoxysilicone · polyethyleneimine composite resin (1:3 by molar ratio) | 10 |
| Ethanol | 100 |

The above-mentioned surface coating layer formation liquid was coated on the surface of spherical ferrite particles with a weight average particle size of 50 μm by fluidized bed spray coating at 60° C. and dried with the application of heat thereto. The surface coating layer with a thickness of about 1 μm was coated on the core ferrite particles. Thereafter, the coated particles were sintered at 160° C. in the atmosphere for 90 minutes using an electric furnace.

Thus, there was provided a carrier comprising carrier particles No. 6 according to the present invention.

The results of the phase imaging measurement are shown in TABLE 1.

The evaluation tests were carried out in the same manner as in Example 1. The evaluation results are shown in TABLE 2.

As a result, the carrier particles No. 6 were evaluated as excellent because the charging performance did not deteriorate after the continuous copying operation, so that high quality images were maintained. The wear of the surface coating layer and the deposition of toner component to the carrier particles were remarkably slight.

EXAMPLE 7

The procedure for preparation of the carrier particles No. 6 in Example 6 was repeated except that the sintering of the carrier core particles coated with the surface coating layer was carried out at 200° C. for 90 minutes so as to adjust the surface configuration of the carrier particles. Thus, a carrier comprising carrier particles No. 7 according to the present invention was obtained.

The results of the phase imaging measurement are shown in TABLE 1.

The evaluation tests were carried out in the same manner as in Example 1. The evaluation results are shown in TABLE 2.

As a result, the carrier particles No. 7 were evaluated as excellent because the charging performance did not deteriorate after the continuous copying operation, so that high quality images were maintained. The wear of the surface coating layer and the deposition of toner component to the carrier particles were remarkably slight.

EXAMPLE 8

The procedure for preparation of the carrier particles No. 6 in Example 6 was repeated except that the sintering of the carrier core particles coated with the surface coating layer was carried out at 160° C. for 180 minutes so as to adjust the surface configuration of the carrier particles. Thus, a carrier comprising carrier particles No. 8 according to the present invention was obtained.

The results of the phase imaging measurement are shown in TABLE 1.

The evaluation tests were carried out in the same manner as in Example 1. The evaluation results are shown in TABLE 2.

As a result, the carrier particles No. 8 were evaluated as excellent because the charging performance did not deteriorate after the continuous copying operation, so that high quality images were maintained. The wear of the surface coating layer and the deposition of toner component to the carrier particles were remarkably slight.

EXAMPLE 9

The procedure for preparation of the carrier particles No. 3 in Example 3 was repeated except that the sintering of the carrier core particles coated with the surface coating layer was carried out at 250° C. for 30 minutes so as to adjust the surface configuration of the carrier particles. Thus, a carrier comprising carrier particles No. 9 according to the present invention was obtained.

The results of the phase imaging measurement are shown in TABLE 1.

The evaluation tests were carried out in the same manner as in Example 1. The evaluation results are shown in TABLE 2.

As a result, the carrier particles No. 9 were evaluated as excellent because the charging performance did not deteriorate after the continuous copying operation, so that high quality images were maintained. The wear of the surface coating layer and the deposition of toner component to the carrier particles were remarkably slight.

EXAMPLE 10

The procedure for preparation of the carrier particles No. 9 in Example 9 was repeated except that the sintering of the carrier core particles coated with the surface coating layer was carried out at 250° C. for 60 minutes so as to adjust the surface configuration of the carrier particles. Thus, a carrier comprising carrier particles No. 10 according to the present invention was obtained.

The results of the phase imaging measurement are shown in TABLE 1.

The evaluation tests were carried out in the same manner as in Example 1. The evaluation results are shown in TABLE 2.

As a result, the carrier particles No. 10 were evaluated as excellent because the charging performance did not deteriorate after the continuous copying operation, so that high quality images were maintained. The wear of the surface coating layer and the deposition of toner component to the carrier particles were remarkably slight.

EXAMPLE 11

The procedure for preparation of the carrier particles No. 4 in Example 4 was repeated except that the sintering of the carrier core particles coated with the surface coating layer was carried out at 200° C. for 90 minutes so as to adjust the surface configuration of the carrier particles. Thus, a carrier comprising carrier particles No. 11 according to the present invention was obtained.

The results of the phase imaging measurement are shown in TABLE 1.

The evaluation tests were carried out in the same manner as in Example 1. The evaluation results are shown in TABLE 2.

As a result, the carrier particles No. 11 were evaluated as excellent because the charging performance did not deteriorate after the continuous copying operation, so that high quality images were maintained. The wear of the surface coating layer and the deposition of toner component to the carrier particles were remarkably slight.

EXAMPLE 12

The procedure for preparation of the carrier particles No. 4 in Example 4 was repeated except that the sintering of the carrier core particles coated with the surface coating layer was carried out at 250° C. for 240 minutes so as to adjust the surface configuration of the carrier particles. Thus, a carrier comprising carrier particles No. 12 according to the present invention was obtained.

The results of the phase imaging measurement are shown in TABLE 1.

The evaluation tests were carried out in the same manner as in Example 1. The evaluation results are shown in TABLE 2.

As a result, the carrier particles No. 12 were evaluated as excellent because the charging performance did not deteriorate after the continuous copying operation, so that high quality images were maintained. The wear of the surface coating layer and the deposition of toner component to the carrier particles were remarkably slight.

COMPARATIVE EXAMPLE 1

The procedure for preparation of the carrier particles No. 2 in Example 2 was repeated except that the sintering of the carrier core particles coated with the surface coating layer was carried out at 200° C. for 90 minutes so as to adjust the surface configuration of the carrier particles. Thus, a comparative carrier comprising comparative carrier particles No. 1 was obtained.

The results of the phase imaging measurement are shown in TABLE 1.

The evaluation tests were carried out in the same manner as in Example 1. The evaluation results are shown in TABLE 2.

As a result, the comparative carrier particles No. 1 showed insufficient charging performance even at the initial stage, so that the obtained images were poor because of considerable fogging. After the continuous copying operation, the wear of the surface coating layer of the carrier particles was noticeable, so that the comparative carrier No. 1 was not acceptable for practical use.

COMPARATIVE EXAMPLE 2

The procedure for preparation of the carrier particles No. 6 in Example 6 was repeated except that the sintering of the carrier core particles coated with the surface coating layer was carried out at 120° C. for 90 minutes so as to adjust the surface configuration of the carrier particles. Thus, a comparative carrier comprising comparative carrier particles No. 2 was obtained.

The results of the phase imaging measurement are shown in TABLE 1.

The evaluation tests were carried out in the same manner as in Example 1. The evaluation results are shown in TABLE 2.

As a result, the comparative carrier particles No. 2 showed sufficient charging performance at the initial stage, so that high quality images were produced. However, after the continuous copying operation, the charging performance was caused to deteriorate by the deposition of toner component to the carrier particles. The image quality obtained after completion of the running test was not acceptable for practical use.

COMPARATIVE EXAMPLE 3

[Preparation of Carrier Particles]

<Composition of Surface Coating Layer Formation Liquid>

| | Parts by Weight |
|---|---|
| Acrylic resin | 10 |
| Carbon black | 1 |
| Toluene | 100 |

The above-mentioned surface coating layer formation liquid was coated on the surface of spherical ferrite particles with a weight average particle size of 50 μm by fluidized bed spray coating at 90° C. and dried with the application of heat thereto. The surface coating layer with a thickness of about 1 μm was coated on the core ferrite particles. Thereafter, the coated particles were sintered at 200° C. in the atmosphere for 90 minutes using an electric furnace.

Thus, there was provided a comparative carrier comprising comparative carrier particles No. 3.

The results of the phase imaging measurement are shown in TABLE 1. Only one resin was employed for the formation of the surface coating layer, so that the composite structure of resin was not formed.

The evaluation tests were carried out in the same manner as in Example 1. The evaluation results are shown in TABLE 2.

As a result, the comparative carrier particles No. 3 showed insufficient charging performance even at the initial stage, so that the obtained images were poor because of considerable fogging. After the continuous copying operation, the deposition of toner component to the carrier particles was noticeable, so that the charging performance was further lowered, which was not acceptable for practical use.

EXAMPLE 13

The carrier particles No. 1 were prepared in the same manner as in Example 1.

The procedure for preparation of the toner particles No. 1 in Example 1 was repeated except that the pulverizing and classifying conditions for preparation of the toner matrix particles were changed so that the weight average particle size of the toner matrix particles was changed from 6.5 to 6.3 μm, and the number-average particle diameter calculated from a cumulative undersize particle number distribution when the toner matrix particles reach a cumulative particle number of 10% in the cumulative undersize particle number distribution was changed from 2.8 to 2.3 μm. Thus, toner particles No. 2 for use in the present invention were obtained.

A two-component developer was prepared by mixing the carrier particles No. 1 and the toner particles No. 2.

Using the above-mentioned two-component developer, the evaluation tests were carried out in the same manner as in Example 1. The evaluation results are shown in TABLE 2.

As a result, the image quality obtained after the running test was acceptable for practical use.

EXAMPLE 14

A two-component developer was prepared by mixing the carrier particles No. 9 obtained in Example 9 and the toner particles No. 2 obtained in Example 13.

Using the above-mentioned two-component developer, the evaluation tests were carried out in the same manner as in Example 1. The evaluation results are shown in TABLE 2.

As a result, the image quality obtained after the running test was acceptable for practical use.

EXAMPLE 15

A two-component developer was prepared by mixing the carrier particles No. 8 obtained in Example 8 and the toner particles No. 2 obtained in Example. 13.

Using the above-mentioned two-component developer, the evaluation tests were carried out in the same manner as in Example 1. The evaluation results are shown in TABLE 2.

As a result, the image quality obtained after the running test was acceptable for practical use.

TABLE 1

| | $SO/\Sigma S(i) \times 100(\%)$ | $S_{min}/\Sigma S(i) \times 100(\%)$ | $S_{max}/\Sigma S(i) \times 100(\%)$ | $S_{mod}/\Sigma S(i) \times 100(\%)$ | $E_{min}/E_{max}$ | Presence of Large Region (2 μm or more) | Fractal Dimension |
|---|---|---|---|---|---|---|---|
| Ex. 1 | 24 | 76 | 24 | 76 | 0.44 | None | 1.32 |
| Ex. 2 | 27 | 73 | 27 | 73 | 0.42 | None | 1.27 |
| Ex. 3 | 36 | 64 | 30 | 64 | 0.55 | None | 1.16 |
| Ex. 4 | 47 | 8 | 47 | 47 | 0.65 | None | 1.52 |
| EX. 5 | 15 | 85 | 15 | 85 | 0.51 | None | 1.21 |
| Ex. 6 | 81 | 19 | 81 | 81 | 0.49 | None | 1.18 |
| Ex. 7 | 75 | 25 | 75 | 75 | 0.42 | None | 1.33 |
| Ex. 8 | 89 | 11 | 89 | 89 | 0.44 | Observed | 1.07 |
| Ex. 9 | 34 | 66 | 27 | 66 | 0.40 | Observed | 1.03 |
| Ex. 10 | 25 | 75 | 19 | 75 | 0.18 | None | 1.11 |
| Ex.11 | 45 | 6 | 45 | 49 | 0.76 | None | 1.61 |
| Ex.12 | 10 | 9 | 7 | 81 | 0.58 | None | 1.43 |
| Comp. Ex. 1 | 8 | 92 | 8 | 92 | 0.41 | Observed | 1.06 |
| Comp. Ex. 2 | 93 | 7 | 93 | 93 | 0.37 | Observed | 1.01 |

TABLE 1-continued

| | $SO/\Sigma S(i) \times 100(\%)$ | $S_{min}/\Sigma S(i) \times 100(\%)$ | $S_{max}/\Sigma S(i) \times 100(\%)$ | $S_{mod}/\Sigma S(i) \times 100(\%)$ | $E_{min}/E_{max}$ | Presence of Large Region (2 μm or more) | Fractal Dimension |
|---|---|---|---|---|---|---|---|
| Comp. Ex. 3 | 95 | 5 | 95 | 95 | 0.64 | Observed | 1.00 |

TABLE 2

| | Initial Stage of Running Test | | | | | | After Completion of Running Test | | | | | | | |
|---|---|---|---|---|---|---|---|---|---|---|---|---|---|---|
| | Charge quantity of toner (−μC/g) | | | Fogging of background (*) | Image density | Other problems in image quality | Charge quantity of toner (−μC/g) | | | Fogging of background (*) | Image density | Deposition of toner | Degree of Wear of carrier | Other problems in image quality |
| | 10 sec. | 60 sec. | 600 sec. | | | | 10 sec. | 60 sec. | 600 sec. | | | | | |
| Ex. 1 | 17.5 | 23.1 | 23.3 | ◎ | 1.45 | — | 16.9 | 22.7 | 23.2 | ◎ | 1.45 | 0.6 | 2 | — |
| Ex. 2 | 18.2 | 24.0 | 23.9 | ◎ | 1.47 | — | 15.5 | 21.8 | 21.6 | ◎ | 1.44 | 1.1 | 2 | — |
| Ex. 3 | 16.7 | 22.2 | 22.5 | ◎ | 1.42 | — | 16.4 | 23.1 | 23.0 | ◎ | 1.43 | 0.9 | 4 | — |
| Ex. 4 | 19.7 | 25.8 | 25.1 | ◎ | 1.40 | — | 14.8 | 24.5 | 24.9 | ○ | 1.39 | 1.7 | 3 | — |
| Ex. 5 | 10.2 | 17.8 | 24.3 | Δ | 1.25 | — | 11.4 | 18.6 | 22.1 | ○ | 1.36 | 1.0 | 7 | — |
| Ex. 6 | 15.4 | 22.1 | 21.9 | ○ | 1.38 | — | 14.1 | 17.0 | 17.8 | Δ | 1.40 | 3.5 | 10 | — |
| Ex. 7 | 17.3 | 28.6 | 27.5 | ◎ | 1.39 | — | 15.6 | 24.4 | 25.0 | ○ | 1.40 | 2.9 | 8 | — |
| Ex. 8 | 17.2 | 21.5 | 20.8 | ○ | 1.41 | — | 11.9 | 19.3 | 18.7 | Δ | 1.42 | 3.1 | 16 | — |
| Ex. 9 | 18.8 | 26.6 | 25.9 | ◎ | 1.43 | — | 13.0 | 17.1 | 18.2 | Δ | 1.46 | 1.8 | 12 | — |
| Ex. 10 | 15.0 | 18.4 | 21.4 | ◎ | 1.40 | — | 14.6 | 17.6 | 19.5 | ○ | 1.38 | 1.4 | 7 | — |
| Ex. 11 | 16.5 | 21.6 | 22.1 | Δ | 1.39 | — | 13.8 | 18.3 | 18.4 | Δ | 1.43 | 1.6 | 15 | — |
| Ex. 12 | 17.2 | 27.5 | 26.7 | Δ | 1.36 | — | 17.5 | 25.6 | 27.8 | Δ | 1.35 | 0.8 | 25 | slight peeling |
| Comp. Ex. 1 | 4.6 | 11.9 | 19.6 | X | 1.40 | uneven image density | 7.7 | 16.5 | 20.1 | Δ | 1.41 | 0.9 | 47 | appearance of non-printed white spots |
| Comp. Ex. 2 | 20.5 | 27.3 | 28.1 | 0 | 1.43 | — | 5.6 | 13.1 | 13.2 | X | 1.19 | 5.4 | 13 | unclear |
| Comp. Ex. 3 | 12.4 | 18.7 | 17.6 | X | 1.39 | slight unevenness of image density | 3.8 | 12.2 | 12.5 | X | 1.21 | 6.1 | 24 | considerably unclear |
| Ex. 13 | — | — | — | ◎ | 1.40 | — | — | — | — | ○ | 1.41 | 1.2 | — | — |
| Ex. 14 | — | — | — | ○ | 1.39 | — | — | — | — | Δ | 1.30 | 4.0 | — | — |
| Ex. 15 | — | — | — | Δ | 1.40 | — | — | — | — | Δ | 1.27 | 2.5 | — | — |

(*)Fogging of background: visually observed.
◎: Excellent
○: Good
A: Slightly poor, but acceptable for practical use
X: Very poor (not acceptable for practical use)

As previously explained, the carrier of the present invention and the two-component developer using the above-mentioned carrier component are remarkably useful for the electrophotographic process. This is because the wear of the surface coating layer of the carrier particles and the adhesion of the toner component to the carrier particles can be minimized even though image formation process is repeated for an extended period of time. Therefore, stable images can be produced without the decrease in image density and the deposition of toner on the background, and at the same time, the image quality can be improved in terms of the precision and the resolution.

Japanese Patent Application No. 11-321412 filed Nov. 11, 1999 is hereby incorporated by reference.

What is claimed is:

1. A carrier comprising carrier particles, each carrier particle comprising a core particle comprising at least a magnetic material and a surface coating layer provided on said core particle comprising at least a resin, said surface coating layer being constituted of a plurality of regions, said regions being separately formed and joined together to form a complex configuration, and having different phase lags when said surface coating layer is subjected to scanning by phase imaging measurement using a scanning probe microscope in a tapping mode, wherein a region having a phase lag over the average phase lag obtained from $E_{avg}=\Sigma(E(i)\cdot S(i))/\Sigma S(i)$ has an area SO, and SO and $\Sigma S(i)$ are in a relationship of $10\% \leqq SO/\Sigma S(i) \times 100 \leqq 90\%$ when each of said regions comprises a component A(i) having an area S(i) and a phase lag E(i), in which i represents the number of regions with different phase lags, wherein said regions include a region that occupies an area $S_{mod}$ which is the maximum area occupied by any one of said regions and wherein said surface coating layer comprises a component $A_{mod}$ forming said region which occupies said maximum area $S_{mod}$, and wherein a boundary between said region formed by said component $A_{mod}$ and a region adjacent thereto has a fractal dimension of 1.1 to 1.6.

2. The carrier as claimed in claim 1, wherein SO and ΣS(i) are in a relationship of $20\% \leqq SO/\Sigma S(i) \times 100 \leqq 75\%$.

3. The carrier as claimed in claim 1, wherein SO and ΣS(i) are in a relationship of $20\% \leqq SO/\Sigma S(i) \times 100 \leqq 50\%$.

4. The carrier as claimed in claim 1, wherein said different phase lags include a minimum phase lag $E_{min}$ and wherein said surface coating layer comprises a component $A_{min}$ having said minimum phase lag $E_{min}$ and forming a region with an area $S_{min}$, $S_{min}$ and ΣS(i) being in a relationship of $S_{min}/\Sigma S(i) \times 100 \leqq 80\%$.

5. The carrier as claimed in claim 4, wherein said region formed by said component $A_{min}$ further comprises silicon atom.

6. The carrier as claimed in claim 1, wherein said different phase lags include a maximum phase lag $E_{max}$ and wherein said surface coating layer comprises a component $A_{max}$ having said maximum phase lag $E_{max}$ and forming a region with an area $S_{max}$, $S_{max}$ and ΣS(i) being in a relationship of $S_{max}/\Sigma S(i) \times 100 \leqq 60\%$.

7. The carrier as claimed in claim 6, wherein said region formed by said component $A_{max}$ further comprises nitrogen atom.

8. The carrier as claimed in claim 1, wherein said different phase lags include a minimum phase lag $E_{min}$ and a maximum phase lag $E_{max}$ and wherein said surface coating layer comprises a component $A_{min}$ having said minimum phase lag $E_{min}$, and a component $A_{max}$ having said maximum phase lag $E_{max}$, said phase lags $E_{min}$ and $E_{max}$ being in a relationship of $0.2 \leqq E_{min}/E_{max} \leqq 0.7$.

9. The carrier as claimed in claim 1, wherein $S_{mod}$ and ΣS(i) are in a relationship of $S_{mod}/\Sigma S(i) \times 100 \leqq 80\%$.

10. The carrier as claimed in claim 9, wherein when a segment with a length of 2 μm is arbitrarily drawn on said region formed by said component $A_{mod}$, said segment stretches over at least a part of said region formed by said component $A_{mod}$ and at least a part of any region other than said region formed by said component $A_{mod}$.

11. The carrier as claimed in claim 9, wherein said region formed by said component $A_{mod}$ further comprises silicon atom.

12. The carrier as claimed in claim 9, wherein said region formed by said component $A_{mod}$ further comprises nitrogen atom.

13. The carrier as claimed in claim 1, wherein any of said regions comprises a siloxane bond.

14. The carrier as claimed in claim 1, wherein any of said regions comprises a polysilazane skeleton.

15. A two-component developer comprising a toner and a carrier, said toner comprising toner particles, each toner particle comprising a binder resin and a coloring agent, and said carrier comprising carrier particles, each carrier particle comprising a core particle comprising at least a magnetic material and a surface coating layer provided on said core particle comprising at least a resin, said surface coating layer being constituted of a plurality of regions, said regions being separately formed and joined together to form a complex configuration, and having different phase lags when said surface coating layer is subjected to scanning by phase imaging measurement using a scanning probe microscope in a tapping mode, wherein a region having a phase lag over the average phase lag obtained from $E_{avg}=\Sigma(E(i)\cdot S(i))/\Sigma S(i)$ has an area SO, and SO and ΣS(i) are in a relationship of $10\% \leqq SO/\Sigma S(i) \times 100 \leqq 90\%$ when each region comprises a component A(i) having an area S(i) and a phase lag E(i), in which i represents the number of regions with different phase lags, wherein said regions include a region that occupies an area $S_{mod}$ which is the maximum area occupied by any one of said regions and wherein said surface coating layer comprises a component $A_{mod}$ forming said region which occupies said maximum area $S_{mod}$, and wherein a boundary between said region formed by said component $A_{mod}$ and a region adjacent thereto has a fractal dimension of 1.1 to 1.6.

16. The two-component developer as claimed in claim 15, wherein said toner particles comprise particles with a particle diameter of 2.5 μm or less with a content ratio of 10% or less by number.

17. A developer container which is filled with a two-component developer comprising a toner and a carrier, said toner comprising toner particles, each toner particle comprising a binder resin and a coloring agent, and said carrier comprising carrier particles, each carrier particle comprising a core particle comprising at least a magnetic material and a surface coating layer provided on said core particle comprising at least a resin, said surface coating layer being constituted of a plurality of regions, said regions being separately formed and joined together to form a complex configuration, and having different phase lags when said surface coating layer is subjected to scanning by phase imaging measurement using a scanning probe microscope in a tapping mode, wherein a region having a phase lag over the average phase lag obtained from $E_{avg}=\Sigma(E(i)\cdot S(i))/\Sigma S(i)$ has an area SO, and SO and ΣS(i) are in a relationship of $10\% \leqq SO/\Sigma S(i) \times 100 \leqq 90\%$ when each region comprises a component A(i) having an area S(i) and a phase lag E(i), in which i represents the number of regions with different phase lags, wherein said regions include a region that occupies an area $S_{mod}$ which is the maximum area occupied by any one of said regions and wherein said surface coating layer comprises a component $A_{mod}$ forming said region which occupies said maximum area $S_{mod}$, and wherein a boundary between said region formed by said component $A_{mod}$ and a region adjacent thereto has a fractal dimension of 1.1 to 1.6.

* * * * *